US009677305B2

(12) United States Patent
Bendel

(10) Patent No.: US 9,677,305 B2
(45) Date of Patent: Jun. 13, 2017

(54) MOTOR VEHICLE DOOR LOCK

(75) Inventor: Thorsten Bendel, Oberhausen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 602 days.

(21) Appl. No.: 14/002,690

(22) PCT Filed: Mar. 5, 2012

(86) PCT No.: PCT/DE2012/000215
§ 371 (c)(1),
(2), (4) Date: Dec. 9, 2013

(87) PCT Pub. No.: WO2012/119581
PCT Pub. Date: Sep. 13, 2012

(65) Prior Publication Data

US 2015/0233157 A1 Aug. 20, 2015

(30) Foreign Application Priority Data

Mar. 4, 2011 (DE) ..... 10 2011 012 999

(51) Int. Cl.
*E05B 85/24* (2014.01)

(52) U.S. Cl.
CPC ..... *E05B 85/243* (2013.01); *Y10T 292/1079* (2015.04)

(58) Field of Classification Search
CPC .... E05B 85/243; E05B 17/0029; E05B 81/00; E05B 81/04; Y10T 292/1079; Y10S 292/23
USPC ..... 292/199, 216, 201
See application file for complete search history.

(56) References Cited

U.S. PATENT DOCUMENTS 3,614,146 A * 10/1971 Marx ..... E05B 85/243 292/216
3,697,105 A * 10/1972 Marx ..... E05B 85/243 292/216
4,334,704 A * 6/1982 Yamada ..... E05B 79/12 292/216
5,921,594 A * 7/1999 Bendel ..... E05B 77/26 292/216

(Continued)

FOREIGN PATENT DOCUMENTS

DE 19642698 A1 4/1998
DE 10048709 A1 4/2002

(Continued)

OTHER PUBLICATIONS

DE10048709 Description.pdf, 6 pages, obtained from ESPACENET.*
First Office Action for Japanese Patent Application No. JP2013-555753, Mar. 29, 2016 (4 pages).

*Primary Examiner* — Andrew Roersma
(74) *Attorney, Agent, or Firm* — Renner, Otto, Boisselle & Sklar, LLP

(57) ABSTRACT

A motor vehicle door lock comprising a locking mechanism (1, 2) and a mechanical lever gear (4, 5) as well as a motor-driven opening unit (7 to 9), which are respectively individually arranged for opening of a locking mechanism (1, 2), wherein in the normal mode, the motorized opening unit (7 to 9) provides a free movement of the lever gear (4, 5) in relation to the locking mechanism (1, 2) and the engagement of the lever gear with the locking mechanism (1, 2) in the opening mode.

8 Claims, 2 Drawing Sheets

(56) References Cited

U.S. PATENT DOCUMENTS

| | | | | |
|---|---|---|---|---|
| 5,997,055 | A * | 12/1999 | Strathmann | E05B 81/06 292/199 |
| 6,439,623 | B1 * | 8/2002 | Lohfeld | E05B 81/20 292/201 |
| 6,575,507 | B2 * | 6/2003 | Reddmann | E05B 81/14 292/201 |
| 6,824,177 | B1 * | 11/2004 | Nass | E05B 81/16 292/201 |
| 6,932,393 | B2 * | 8/2005 | Erices | E05B 81/06 292/216 |
| 7,152,890 | B2 * | 12/2006 | Torkowski | E05B 81/14 292/201 |
| 2002/0089188 | A1 * | 7/2002 | Edgar | E05B 85/243 292/216 |
| 2003/0038485 | A1 * | 2/2003 | Schwaiger | E05B 81/14 292/201 |
| 2004/0094971 | A1 * | 5/2004 | Warmke | E05B 81/06 292/201 |
| 2005/0040658 | A1 * | 2/2005 | Larsen | E05B 81/14 292/229 |
| 2006/0131893 | A1 * | 6/2006 | Tomaszewski | E05B 81/06 292/216 |
| 2008/0078215 | A1 * | 4/2008 | Odahara | E05B 81/06 70/91 |
| 2008/0203737 | A1 * | 8/2008 | Tomaszewski | E05B 77/26 292/216 |
| 2010/0072761 | A1 * | 3/2010 | Tomaszewski | E05B 77/26 292/201 |

FOREIGN PATENT DOCUMENTS

| | | | | |
|---|---|---|---|---|
| DE | 10139975 | A1 | 4/2002 | |
| DE | 202008003845 | U1 | 8/2009 | |
| EP | 0942134 | A2 | 9/1999 | |
| EP | 0959205 | A1 * | 11/1999 | E05B 47/00 |
| EP | 1362971 | A1 * | 11/2003 | E05B 65/20 |
| JP | 2004-511687 | A | 4/2004 | |

* cited by examiner

MOTOR VEHICLE DOOR LOCK

CROSS REFERENCE TO RELATED APPLICATIONS

This application claims priority under 35 U.S.C. 119 and 35 U.S.C. 365 based upon German Patent Application No. 10 2011 012 999.5, filed on Mar. 4, 2011. The entire disclosure of the aforesaid application is incorporated herein by reference.

FIELD OF THE INVENTION

The invention relates to a motor vehicle door lock comprising a locking mechanism and a mechanical lever gear as well as a motor-driven opening unit, which are respectively individually arranged for opening of the locking mechanism.

BACKGROUND OF THE INVENTION

Such motor vehicle door locks are, for instance, known from prior art disclosed by the applicant in DE 20 2008 003 845 U1 or from DE 196 42 698 A1. In the latter case, DE 196 42 698 A1 discloses that in the normal case or normal mode a handle part of a door handle is fixed in its normal position. After unlocking of the door lock, a respective motor vehicle door can be opened without pivoting, by simply pulling on the handle part.

In case of an emergency or a crash, such as a collision, an electronic control system evaluates a signal of a respective collision sensor. As a result, a locking bolt is retracted, which previously blocked the handle part of the door handle. The door lock can subsequently be opened mechanically. In contrast, the door lock is opened by an electric motor or a motorized opening unit when in normal mode.

The know procedure has generally proven to be a successful solution, reaches however its limits when the motorized opening unit in the normal mode is not or no longer able to open the locking mechanism, as in this functional position no mechanical opening was originally provided. Also the design effort and consequently the financial cost for implementing such a motor vehicle door lock are enormous.

SUMMARY OF THE INVENTION

The invention is based on the technical problem of further developing a motor vehicle door lock of the aforementioned design in such a way that, whilst maintaining the correct functionality, the lock also offers the option to mechanically support the opening process. The aim is also to achieve this with a simple design and an inexpensive arrangement.

To solve this technical problem, a generic motor vehicle door lock according to the invention is characterized by the motorized opening unit allowing free movement of the lever gear in relation to the locking mechanism in the normal mode and ensuring its engagement with the locking mechanism in the opening operation.

As part of the invention, the normal mode corresponds with the motor vehicle door lock or its locking mechanism not being opened and also respective measures not being carried out. In contrast, the opening operation involves the locking mechanism being opened by a pawl that is lifted off an associated rotary latch. As a result of this process a locking bolt, previously captured by the rotary latch, is released.

As the locking bolt is generally connected to a motor vehicle door, this process enables an associate motor vehicle door, motor vehicle door flap, etc. to be opened, which is desirable Unintentional opening should, however, be prevented.

Such unintentional opening can, for instance, be caused by acceleration forces generated during an accident or crash. According to the invention, such unintentional opening is not permitted as in the associated normal mode (this also includes the event of a crash) the motorized opening unit ensures the free movement of the mechanical lever gear in relation to the locking mechanism. In other words, such activations of the mechanical lever gear in the normal mode (also in case of a crash) results in associated pivoting movements, which in relation to the locking mechanism are moving freely or are idling, i.e. do not result in the pawl lifting or being able to lift off the rotary latch. This prevents any unintentional opening of the associated motor vehicle door.

The locking mechanism is opened only when and if the motorized opening unit is activated by a respective opening signal forwarded to an electric motor of the motor-driven opening unit. As in this case the opening operation takes place and the and motorized opening unit ensures that the mechanical lever gear is moved to engage with the locking mechanism. The force acting on the mechanical lever gear then ensures that the pawl is lifted off the rotary latch and can also be lifted off it.

In addition, not only the motorized opening unit ensures or can ensure the opening of the locking mechanism during the opening operation. The locking mechanism opening is in fact assisted by the mechanical lever gear which is in engagement with the locking mechanism. In this context, minimum displacement of the electric motor of the motor-driven opening unit already suffices for the mechanical lever gear to engage with the locking mechanism. As a result, also situations in which, for instance, the power of the electric motor is insufficient to lift the pawl as such off the rotary latch can be managed without problem, as this process is mechanically supported by the invention.

As, in addition, the motorized opening unit operates advantageously in one direction only, this unidirectional operation also suffices in the event of a crash to ensure that with the assistance of the mechanical lever gear, the opening process of the locking mechanism is supported and can actually be carried out (where required). Consequently, no elaborate electronic measures are required and a simply constructed electric motor drive suffices due to its unidirectional design.

A spring usually added in this context to the drive ensures that the motorized opening unit is acted upon inversely to the (unidirectional) drive direction. As a result, the motorized opening unit can be easily moved (back) into its original position with the aid of the spring after cessation of the drive. This corresponds to the normal mode and consequently the free movement of the lever gear in relation to the locking mechanism.

Either way, the locking mechanism can be easily and reliably opened in each case due to the realized mechanical redundance, as it suffices that the electric motor of the motor-driven opening unit moves only a short travel, which as such does not or may not suffice to lift the pawl of the rotary latch. This short travel is indeed (only) able to move the mechanical lever gear from its free movement to being engaged with the locking mechanism. As a result, the mechanical lever gear can support or fully handle the opening process of the locking mechanism. This is all achieved with surprisingly simple means and is consequently particularly cost-effective. These are the main advantages of the invention.

According to a further advantageous embodiment, the mechanical lever gear contains an actuating lever interacting with the locking mechanism. This means that the actuating lever arranged directly in the vicinity of the locking mechanism ensures in essence that in the normal mode the mechanical lever gear moves freely compared to the locking mechanism and is in engagement with the locking mechanism in the opening operation.

For this purpose, the actuating lever normally contains a profile for a journal engaging therein. In most cases this journal is a mechanical connecting journal between the pawl and the actuating lever. The journal can, indeed, be mounted on or in a connecting link arranged between the actuating lever and the pawl. The journal is arranged perpendicularly to this connecting link and mechanically connects the pawl to the actuating lever.

The profile in the actuating lever typically consists of two parts. The profile is indeed generally divided into a free-movement area and an engagement area. It has also proven to be advantageous if the profile is L-shaped. This is because in this context the L-leg acts as a free movement area, whilst the other L-leg is designed as an engagement area. The L-leg designed as a free-movement area is typically the vertical L-leg, whilst the L-leg defining the engagement area is designed as a horizontal L-leg.

If the connecting journal between the pawl and the actuating lever is located in the free movement range or the associated L-leg of the L-shaped profile in the actuating lever, the actuating lever can be pivoted around its axis, without these pivoting movements being transferred to the pawl. Instead, the journal in question moves during this process along the free movement range or along the vertical L-leg. The pivoting movements of the actuating lever therefore have no effect. The mechanical lever gear runs freely. This corresponds to the normal mode.

If, however, the opening operation is initiated and the motorized opening unit is acted upon for this purpose, it ensures that the journal or the connecting journal leaves the free-movement area and enters the engagement area. As a result, the mechanical connecting journal is immersed between the pawl and the actuating lever into the engagement area or horizontal L-leg of the L-shaped profile of the actuating lever. Pivoting movements in this functional position consequently cause pivoting movements of the actuating lever to be transferred to the connecting journal and the pawl being "carried along" by the connecting journal. In this way, the pawl is lifted off the rotary latch and the rotary latch is opened with the aid of a spring. A previously engaged locking bolt is released with the respective consequences.

In order to implement this in detail, the actuating lever and the pawl of the locking mechanism are arranged on the same axis. In fact, the actuating lever and the pawl are usually housed together on a common axis inside a lock case of the door lock.

As already explained above, the motorized opening unit operates unidirectionally and contains an electric motor. This electric motor acts on a driving pulley driven by said motor. The driving pulley as such, is usually provided with a cam. In most cases, the cam is designed as a drive cam.

The drive cam can, on one hand, interact with a stop element on the pawl and, on the other hand, with an actuator. As soon as the drive cam moves against the stop element of the pawl, the pawl is lifted off the drive cam by the rotary latch. As a result, the rotary latch can open. Before or at the same time, the drive cam ensures, on the other hand, that the aforementioned actuator is acted upon.

The actuator ensures the positional changes of the journal or of the mechanical connecting journal between the pawl and the actuating lever. As already described, the journal can either be positioned in the free-movement range of the profile of the actuating lever and, on the other hand, in its engagement area. This defines, on one hand, the normal mode and, on the other hand, the opening mode. The actuator acts on the journal to achieve these different positions. For this purpose, the actuator is, in turn, acted upon by the motor-driven opening unit.

The actuator acts upon the journal in such a way that, in its normal mode, the journal is arranged in the free-movement area and in the opening operation in the engagement area of the profile on the actuating lever. To achieve this, the actuator is advantageously designed as a swiveling lever. The actuator or the swiveling lever is consequently functionally located between the motorized drive and the journal or connecting journal. For this purpose, the actuator can be positioned between the pawl and the actuating lever and can directly act on the connecting link supporting the journal.

For this purpose, the actuator or the swiveling lever are generally located around the centre of an axis. One end of the swiveling lever contains a stop or a stop journal against which the cam of the motor-driven opening unit abuts in order to move the swiveling lever. In any case, the swiveling lever mechanically couples the cam of the driving pulley of the motor-driven opening unit with the journal. A return spring additionally associated with the actuator or swiveling lever ensures that, when no longer acted upon by the motorized opening unit, the swiveling lever or the actuator return to their original position.

BRIEF DESCRIPTION OF THE DRAWINGS

Below, the invention is explained in detail with reference to exemplary drawings showing only one embodiment, as follows.

Figure 1:
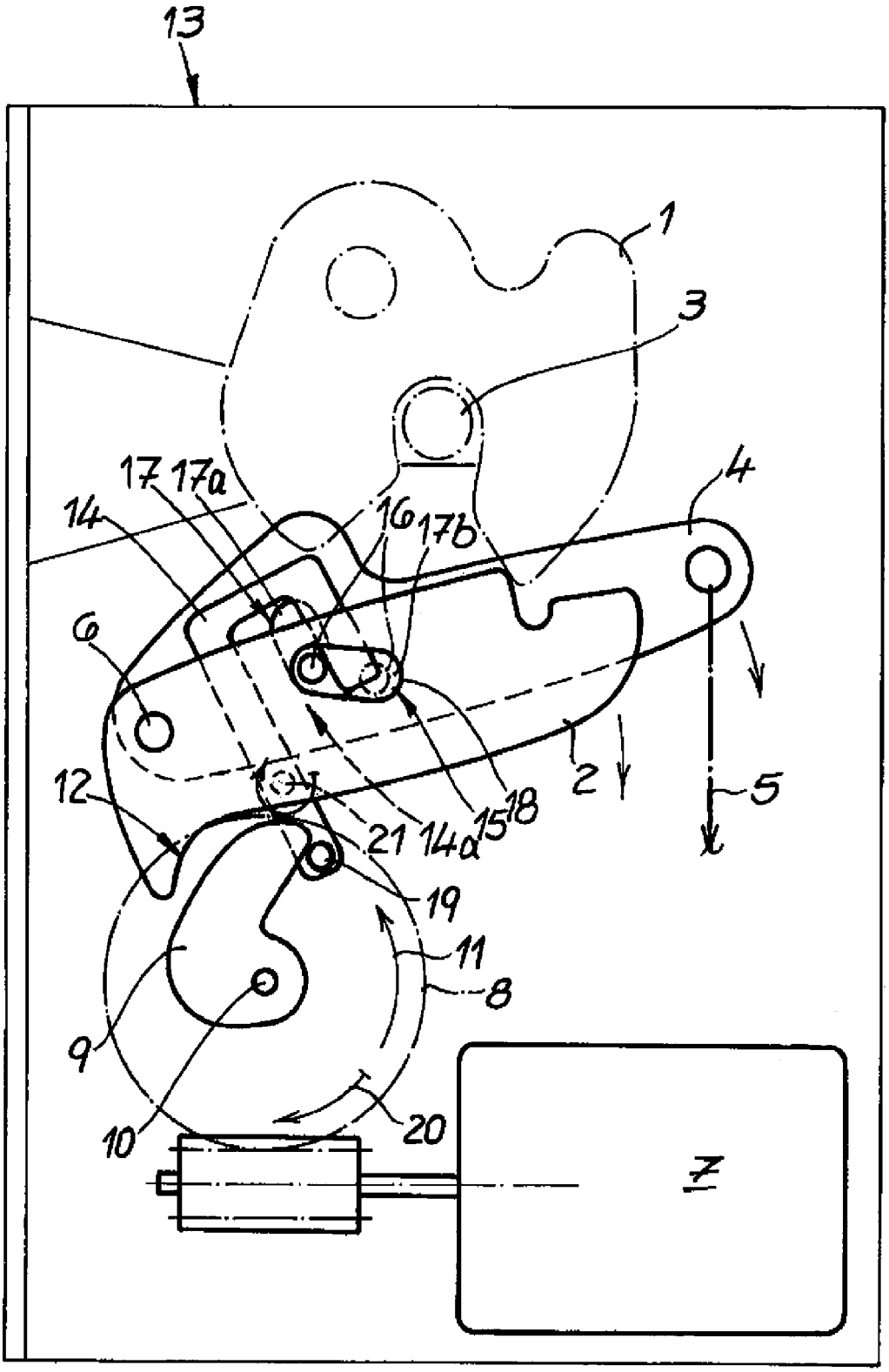
FIG. 1 shows a section of the motor vehicle door lock normal mode.

Other features and advantages of the present invention will become apparent from the following detailed description, taken in conjunction with the accompanying drawings which illustrate, by way of example, the principles of the invention.

DETAILED DESCRIPTION OF THE INVENTION

The figures show a motor vehicle door lock, the basic arrangement of which contains a locking mechanism 1, 2 comprising a rotary latch 1 and a pawl 2 interacting in the usual manner with the rotary latch 1. In general, the locking mechanism 1, 2 can also contain a pawl lever 2 instead of the shown pawl 2, which then interacts in the usual manner with the pawl, not shown in the drawing. The functionality of the pawl lever 2 is the same as that of the pawl 2 described below. In other words, the lever with reference number 2 can generally be a pawl lever 2 acting on a pawl, not show, which in turn interacts with the rotary latch 1. The described example does not contain this pawl lever 2 but instead pawl 2, as shown in the figures. All functions described below are, however, feasible when using pawl 2 and, alternatively, pawl lever 2 as part of the example not shown and are part of the invention.

Figure 2:
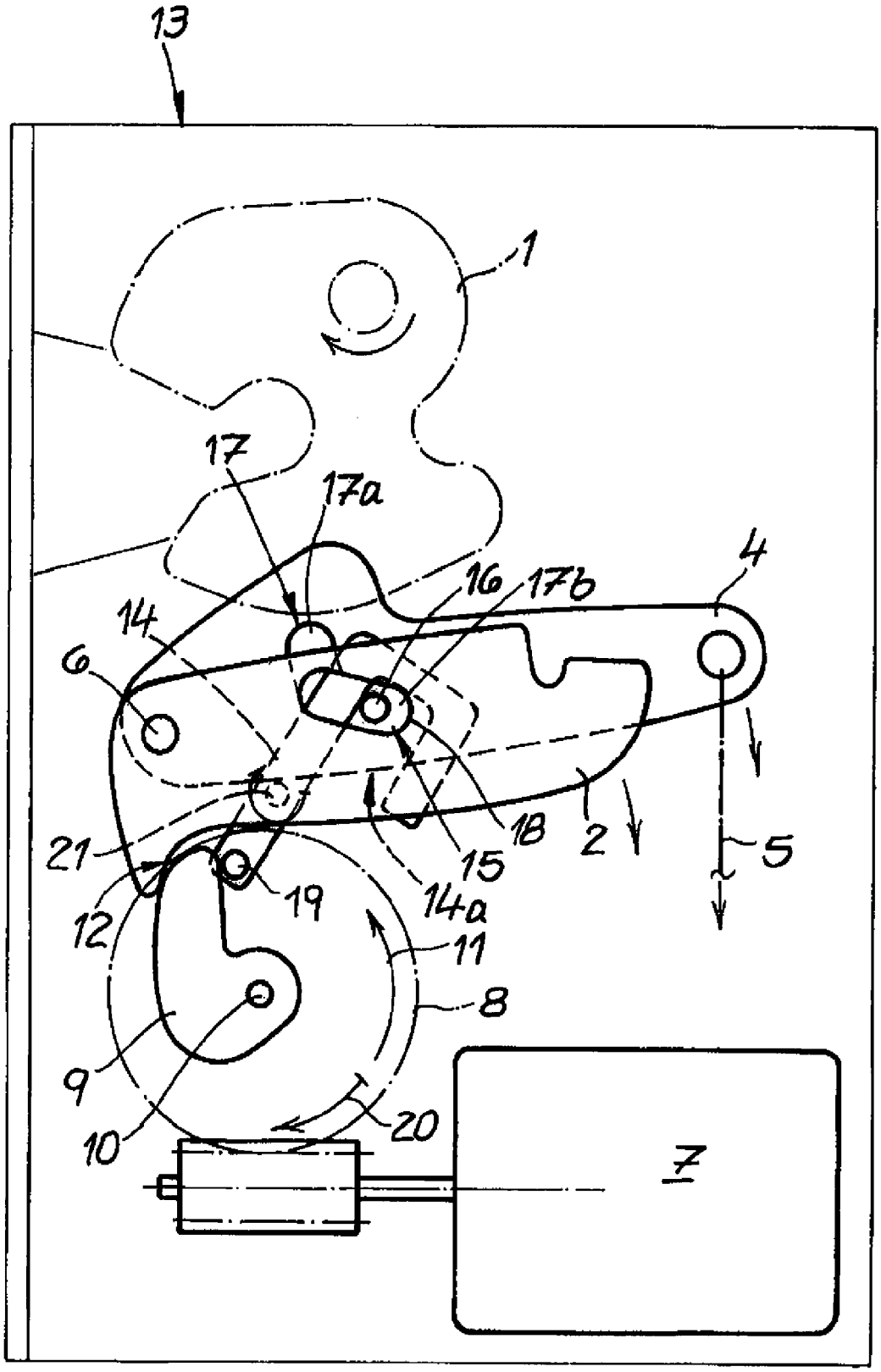
FIG. 2 shows the object of FIG. 1 in the opening operation.

FIG. 1 shows the normal mode of the motor vehicle door lock with the pawl 2 engaged with the rotary latch 1. As a result, a locking bolt 3—only indicated—is caught and an associated motor vehicle door—not shown—is locked. In contrast, FIG. 2 shows the opening operation. In this case, the pawl 2 has been lifted off the rotary latch 1 and can open the rotary latch 1 by means of a spring—not shown—and release the locking bolt 3. The same applies to the motor vehicle door.

Part of the further general arrangement of the motor vehicle door lock is a mechanical lever gear 4, 5. The mechanical lever gear 4, 5 contains one actuating lever 4 and one or several levers 5 acting on the actuating lever 4. In order to be able to lift the pawl 2 off the closed rotary latch 1 with the aid of the actuating lever 4, the actuating lever 4 must be pivoted clockwise around its axis 6, as shown by the arrow indicated in FIG. 1. This means that the mechanical lever gear 4, 5 is configured for opening the locking mechanisms 1, 2.

A motorized opening unit 7 to 9 is also able to open the locking mechanisms 1, 2. For this purpose, the motorized opening unit 7 to 9 contains an electric motor 7 and a driving pulley 8 driven by the electric motor in the embodiment. The driving pulley 8 contains a cam 9. The cam 9 is designed as a drive cam.

Starting from the functional position shown in FIG. 1 or the normal mode, an anticlockwise pivoting movement of the driving pulley 8, initiated by the electric motor 7, around its axis 10 according to the drive direction 11, ensures that the cam or the drive cam 9 interacts with a stop element 12 on the pawl 2.

This stop element 12 may be a stop edge, a stop profile, etc., which enters into the adjustment range of the drive cam 9 in normal mode. As a result, the drive cam 9 is, after completing a certain adjustment, able to act upon the pawl 2 at its stop element 12. As a result, the pawl 2 is pivoted around its axis 6 in clockwise direction as shown by an arrow in FIG. 1. The pawl 2 is consequently lifted off the rotary latch 1 and the locking mechanism 1, 2 is opened.

The pawl 2 and the actuating lever 4 are arranged on a common axis 6 in a lock case 13, only indicated in the drawing. The motorized opening unit 7 to 9 and the driving pulley 8 with its respective axis or axis of rotation 10 is also housed in the lock case 13. The electric motor 7 acts on the driving pulley 8 by means of a known worm drive gear, with the worm drive gear engaging in external teeth on the driving pulley 8 in the known manner.

Before the described motorized opening of the locking mechanism 1, 2 or before the drive cam 9 lifts the pawl 2 of the rotary latch 1 by means of the stop element 12 or also at the same time, the drive cam 9 ensures that an actuator 14 is acted upon. This actuator 14 is designed as a swiveling lever. In the embodiment, the actuator or the swiveling lever 14 is functionally and topologically arranged between the pawl 2 and the actuating lever 4. A connecting link 15, supporting a journal 16, is also arranged between said levers 2, 4. The journal 16 is in this case a mechanical connecting journal 16 between the pawl 2 and the actuating lever 4. Also apparent is an L-shaped and thus at least two-part profile 17 in the actuating lever 4 for the journal 16 to engage therein.

The L-shaped profile 17 in the actuating lever 4 contains a free-movement area 17*a* in the vertical leg 17*a* and an engagement area 17*b* in the horizontal other L-leg 17*b*. The pawl 2 has a profile 18, which as a whole is, however, horizontal and slot-shaped. The journal or the connecting journal 16 extends through the profile 18 of the pawl 2, the connecting link 15 and then the profile 17 in the actuating lever 4, in this sequence. Naturally, this is not mandatory and only applies to the shown embodiment. As a result, the journal or connecting journal 16 extends perpendicularly to the plane of projection and thus also perpendicularly to the two levers 2, 4.

The arrangement functions as follows. In the normal mode shown in FIG. 1, the motorized opening unit 7 to 9 ensures that the lever gear 4, 5 carries out a free movement in relation to the locking mechanism 1, 2. The normal mode corresponds with the drive cam 9 on the driving pulley 8 abuts on the stop journal 19 of the actuator or swiveling lever 14 in such a way that the actuator or the swiveling lever 14 does not act upon the connecting journal 16. Like the drive cam 9, the actuator or the swiveling lever 14 is in its base position.

In this base position, the electric motor 7 is not energized. Also, a spring 20 acting against the drive direction 11, assigned to the motor-driven opening unit 7 to 9 ensures that the drive cam 9 takes up and maintains the respective base position. The same applies to the actuator or the swiveling lever 14 to which also a spring—not shown—is assigned and which holds said actuator or lever in the base position shown in FIG. 1.

In this base position of the motor-driven opening unit 7 to 9 and thus of the actuator or of the swiveling lever 14, the journal 16 supported on the connecting link 15 is in the free-movement area 17*a* of profile 17 of the actuating lever 4. Also, the respective journal 16 is arranged on the left end of the horizontal slot-like profile 18 in the pawl 2. As soon as the mechanical lever gear 4, 5 is being acted upon in this normal mode, the connecting journal 16 moves along the vertical L-leg or the free-movement area 17*a* of the actuating lever 4. The mechanical lever gear 4, 5 is acted upon in the normal mode in such a way that the actuating lever 4 carries out a clockwise movement around its axis 6 shared with pawl 2 and indicated by the arrow in FIG. 1. During this process, the pawl 2 consequently rests and is thus not lifted off the rotary latch 1.

If, however, the motor vehicle door lock moves into the opening operation, the functional position shown in FIG. 2 is reached at the end of the associated actuation movement of the motor-driven opening unit 7 to 9 The opening operation can, for instance, be initiated by the activation of a switch, activation of a handle, etc., which as a whole corresponds to the electric motor 7 of the motor-driven opening unit 7 to 9 being acted upon.

Due to the unidirectional design of the motor-driven opening unit 7 to 9, the energizing of the electric motor 7 ensures that the driving pulley 8 is moved in the drive direction 11 in clockwise direction around its axis 10. As a result, the drive cam 9 leaves the stop journal 19 on the swiveling lever 14. Consequently, the swiveling lever 14 turns around its axis 21 in clockwise direction with the aid of a spring. This is apparent when comparing the functional positions of the swiveling lever 14 in the transition from FIG. 1 to FIG. 2.

As the swiveling lever or the actuator 14 contains a U-shaped guiding area 14*a* for the journal 16 accommodated therein, the journal 16 follows the pivoting movement of the swiveling lever 14. In this way, the connecting journal 16 is moved from the free-movement area 17*a* of profile 17 in the actuating lever 4 into the engagement area 17*b*. At the same time, the connecting journal 16 moves from the left end of the slot-like profile 18 in the pawl 2 to the right end. This is shown by the dashed lines in FIG. 1, with FIG. 2 showing the final position. To initiate the movement of the swiveling lever or actuator 14 in the described sense, a return spring may be assigned to the actuator or swiveling lever 14.

As soon as the drive cam 9 releases the swiveling lever or the actuator 14, the swiveling lever or the actuator 14 can—as a result of being acted upon by the return spring—carry out the movement of the transition from FIG. 1 to FIG. 2. As part of this process, the connecting journal 16 is moved into the engagement area 17*b*. The motorized opening unit 7 to 9 thus ensures the engagement of the mechanical lever gear 4, 5 directly at the start of the opening operation. The further rotary movement of the drive cam 9 now causes the drive cam 9 to interact with the stop element 12 on the pawl 2, lifting it off the rotary latch 1. In this context the mechanical lever gear 4, 5 can assist—where required—as the mechanical lever gear 4, 5 is in engagement with the locking mechanism 1, 2.

Indeed the fact that the actuating lever 4 of the mechanical lever gear 4, 5 is moved around its axis 6 in clockwise direction ensures that the connecting journal 16 located in the engagement area 17*b* "carries along" the pawl 2. If, for instance the force of the electric motor 7 does not suffice to lift the pawl 2 off the rotary latch 1, the mechanical lever gear 4, 5 can assist at this point. For this purpose, the actuating lever 4 or the lever gear 4, 5 can be acted upon by a door handle—not expressly shown—such as an internal door handle and/or external door handle.

It is to be understood that the above-described embodiment is illustrative of only one of the many possible specific embodiments which can represent applications of the principles of the invention. Numerous and varied other arrangements can be readily devised by those skilled in the art without departing from the spirit and scope of the invention.

What is claimed is:

1. A motor vehicle door lock comprising:

a locking mechanism having a pawl is moveable between a closed position and an open position;

a mechanical lever gear that is a arranged on a common axis with the pawl and pivotable to move the pawl to the open position;

a journal mechanically connected between the pawl and the mechanical lever gear, wherein the mechanical lever gear includes an L-shaped profile for the journal to engage therein and the pawl includes a slot-shaped profile for the journal to engage therein;

a swiveling lever arranged between the pawl and the mechanical lever gear, the swiveling lever having a guiding area for receiving the journal, the journal following pivoting movement of the swiveling lever; and a motorized opening unit having a unidirectional motor and a pulley that is driven by the unidirectional motor and rotatable from a first position to a second position, wherein when the pulley is in the first position, the pulley acts on the swiveling lever to prevent the swiveling lever from acting on the journal, the journal being freely moveable within a first leg of the L-shaped profile of the mechanical lever gear, and the journal being located at a first end of the slot-like profile of the pawl, the mechanical lever gear being freely moveable relative to the locking mechanism without moving the pawl towards the open position, and wherein when the pulley is in the second position, the pulley releases the swiveling lever, the swiveling lever having pivoting movement and the journal following the pivoting movement to move to a second leg of the L-shaped profile of the mechanical lever gear and a second end of the slot-like profile of the pawl, enabling the mechanical lever gear to move the pawl towards the open position via the journal carrying the pawl.

2. The motor vehicle door lock according to claim 1, wherein the first leg of the L-shaped profile of the mechanical lever gear includes a free-movement area and the second leg of the L-shaped profile includes an engagement area.

3. The motor vehicle door lock according to claim 1, wherein a spring acting against a drive direction is assigned to the motorized opening unit.

4. The motor vehicle door lock according to claim 1, wherein the pulley contains a cam.

5. The motor vehicle door lock according to claim 4, wherein the pawl has a stop element and wherein the cam is configured as a drive cam interacting with the stop element on the pawl and with the swiveling lever.

6. The motor vehicle door lock according to claim 1, wherein the swiveling lever mechanically couples the cam of the pulley to the journal.

7. The motor vehicle door lock according to claim 1, wherein a return spring is assigned to the motorized opening unit.

8. The motor vehicle door lock according to claim 1, wherein the swiveling lever is u-shaped and the guiding area that accommodates the journal is u-shaped.

* * * * *